US009468236B1

(12) United States Patent
Sherry

(10) Patent No.: US 9,468,236 B1
(45) Date of Patent: Oct. 18, 2016

(54) INFLATABLE BRA

(71) Applicant: Raymond C. Sherry, Cleburne, TX (US)

(72) Inventor: Raymond C. Sherry, Cleburne, TX (US)

( * ) Notice: Subject to any disclaimer, the term of this patent is extended or adjusted under 35 U.S.C. 154(b) by 128 days.

(21) Appl. No.: 14/447,938

(22) Filed: Jul. 31, 2014

Related U.S. Application Data

(60) Provisional application No. 61/958,561, filed on Jul. 31, 2013.

(51) Int. Cl.
*A41C 3/00* (2006.01)
*A41C 3/10* (2006.01)

(52) U.S. Cl.
CPC ..... *A41C 3/105* (2013.01)

(58) Field of Classification Search
CPC ..... A41C 3/105; A41C 3/10; A41C 3/146
See application file for complete search history.

(56) References Cited

U.S. PATENT DOCUMENTS 76,894 A 4/1868 Cook
3,916,948 A * 11/1975 Benjamin ..... A61M 39/22 137/559
5,024,628 A 6/1991 Sanchez
5,179,792 A * 1/1993 Brantingham ..... A43B 3/0005 251/4
5,309,573 A * 5/1994 Solar ..... A41D 9/01582 2/160
5,347,656 A * 9/1994 Fabritz ..... A41C 3/105 2/67
5,375,345 A * 12/1994 Djuric ..... A43B 3/00 36/3 B
5,833,515 A * 11/1998 Shahbazian ..... A41C 3/105 2/267
5,846,063 A * 12/1998 Lakic ..... A41D 19/001 2/413
5,847,404 A 12/1998 Grady
6,080,037 A * 6/2000 Lee ..... A41C 3/105 2/67
6,302,760 B1 * 10/2001 Dai ..... A41C 3/105 450/38
6,461,221 B1 * 10/2002 Stilwell ..... A41C 3/0007 450/38
6,691,730 B1 2/2004 Chen
6,921,316 B1 * 7/2005 Jian ..... A41C 3/105 450/38
7,115,321 B2 10/2006 Soerens et al.
7,201,630 B2 4/2007 Cope
7,413,495 B1 8/2008 Sobah-Wilhelm
7,427,226 B1 9/2008 Deal
7,517,273 B2 4/2009 Wooten
7,759,538 B2 * 7/2010 Fleischmann ..... A61M 1/0088 602/48
7,942,722 B2 5/2011 Tseng
8,047,891 B1 * 11/2011 Albritton ..... A41C 3/105 450/38

(Continued)

*Primary Examiner* — Khoa Huynh
*Assistant Examiner* — Megan Brandon
(74) *Attorney, Agent, or Firm* — Roger N. Chauza, PC

(57) ABSTRACT

An inflatable bra having a bladder in each cup, and a switchable valve built into the bra for allowing the bladders to be inflated one at a time, or together. A separate handheld pump can be connected to the switchable valve for inflating each bladder, or deflating each bladder. A control band is attached under each bra cup and spans the gore of the bra to maintain the bra cups from spreading apart, and a mesh material provides a stiffening agent in each bra cup to counteract bulging of the bra at the locations of the bladders.

9 Claims, 6 Drawing Sheets

(56) References Cited

U.S. PATENT DOCUMENTS 8,124,549 B2 2/2012 Torres et al.
8,641,475 B1 * 2/2014 Hung-Ming ..... A41C 3/10 450/38
8,801,495 B1 * 8/2014 Guindon ..... A41C 3/105 450/36
2009/0318058 A1 * 12/2009 Chen ..... F16K 15/147 450/38
2010/0068973 A1 * 3/2010 Tseng ..... A41C 3/105 450/55
2011/0065358 A1 * 3/2011 Fleeton ..... A41C 3/105 450/38
2012/0073161 A1 * 3/2012 Doyle ..... A43B 13/206 36/29
2013/0012100 A1 * 1/2013 Chen ..... A41C 3/105 450/38
2013/0260639 A1 * 10/2013 Lin ..... A41C 3/105 450/38
2015/0351465 A1 * 12/2015 Duraku ..... A41C 3/105 450/38

* cited by examiner

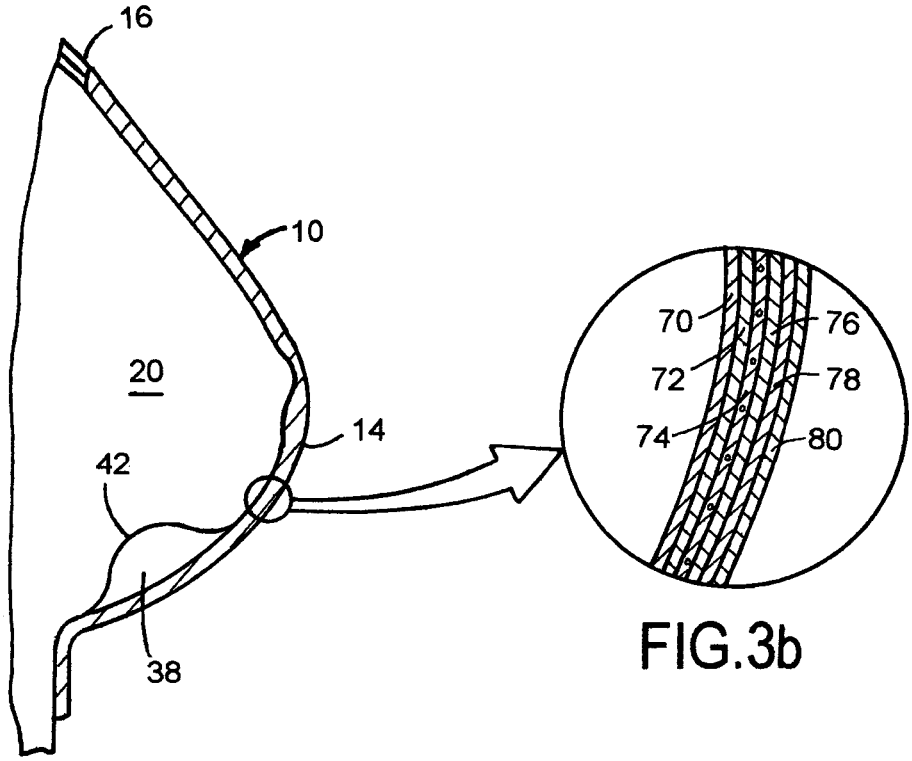
FIG.3b
FIG.3a
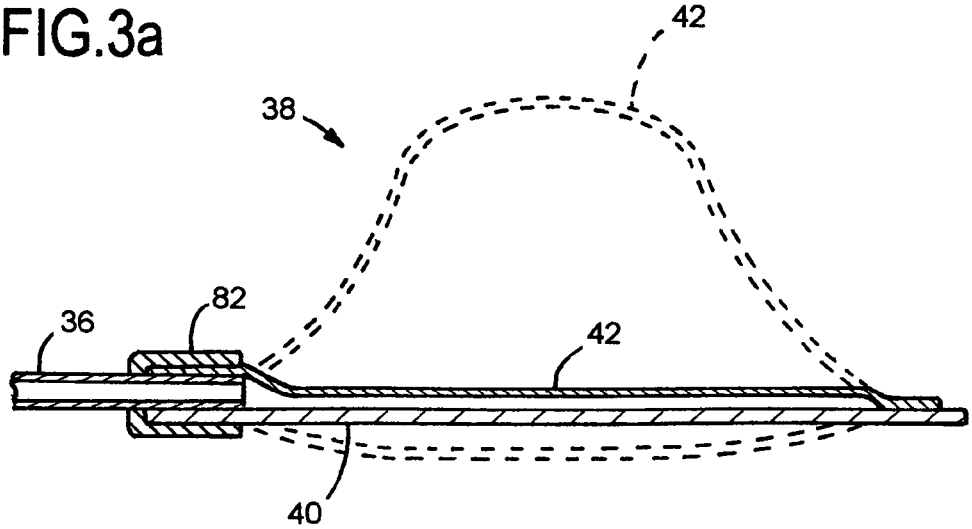
FIG.4

INFLATABLE BRA

TECHNICAL FIELD OF THE INVENTION

The present invention relates in general to wearing apparel, and more particularly to undergarments and outer garments employing bra structures.

BACKGROUND OF THE INVENTION

The brassiere or "bra" was developed in the early 19$^{th}$ century to replace the corset to cover and support a woman's breasts. As early as 1868, a breast pad was patented (U.S. Pat. No. 76,894) that had inflatable sacks covered with an outer knit covering that was non-elastic. The breast pad also had a flannel material that absorbed moisture arising from perspiration. Nevertheless, early bras were designed not only to support the breasts of a woman, but to also to conceal the breasts so as not to emphasize the bosom. According to current social standards, a bra is often worn by many women to emphasize the breasts and make her physical attributes highly visible. As such, the female breasts have achieved an unprecedented iconic status. Bras are manufactured in many different styles and shapes to accomplish the desires of the wearer, such as allow freedom of movement of the breasts, expose a portion of the breasts, lift the breasts to provide a fuller appearance, expose the nipple shape through the bra material, to address breast reduction, breast enhancement, etc. Accordingly, bras not only provide a support function, but also a fashion item. It is not unusual to see women wearing bras where portions thereof are intentionally exposed, such as the shoulder straps. Indeed, some bras, such as bustiers, are more fashionable than functional. Special bras are also fabricated to address concerns after a woman has had breast surgery so that a normal dress appearance is provided.

According to the norms of the Western culture, the appearance of a woman is important, not only to men, but also to other women. The shape of a woman's body is often what is noticed first, by both women and men. While many parts of a woman's body appeal to the opposite sex, it is a woman's breasts that are most often the object of appeal. Despite that a bra generally does nothing other than provide comfort and shape to the breasts, most women feel obligated to wear a bra to support and/or emphasize the shape or size of their breasts. Contrary to many beliefs, a bra does not prevent sagging, even after prolonged use, but rather supports the breast once the breast tissue loses its ability to support itself. The size of a woman's breasts is often as important as a woman's facial appearance. To that end, the field of breast augmentation by surgical and other means is a billion dollar business that grows every year. Rather than resort to surgery to increase the breast size, many bras, such as push-up bras, are constructed to enhance the cleavage and make the breast size appear larger than the actual size. Accordingly, many bras are made to displace the breast tissue upwardly so that it appears that the breast size is one or two cup sizes larger.

The conventional bra is constructed to often include a chest band that encircles the rib cage, and is fastened at each side by respective wings (or back wings) that extend to the back of the woman. The back ends of the wings are fastened together by hook and loop fasteners, or the like. Some bras are constructed to fasten at the front, between the cups. The cups of the bra are sewn to the frontal part of the chest band, and often a shoulder strap connects the top of each cup to the back portion of the respective wing. The frontal section of the bra that connects the cups together is known as the gore. There are many variations of the foregoing in designing bras. For example, some bras dispense with the shoulder straps, some do not have individual cups but rather a band of elastic material covering both breasts, i.e., tube bras, other bras have many different configurations of cup shapes and sizes to address the desires and needs of different users. In order to provide better support, some bras include underwire stiffeners under the cups.

Studies show that less than 45% of women wear bras that do not fit properly. A properly fitted bra must take into consideration the different chest dimensions, the larger dimensions around the body at the breast level, the size of the cups, and the shoulder strap lengths. Not only are there different size bras that attempt to allow the bras to be adjusted lo accommodate the various dimensions of the user, but each bra can be adjusted to a certain extent in an attempt to match the body structure of the woman. Generally, the cup size of a bra is not adjustable, and thus if a different cup size is desired, then a different bra must be purchased. It can be seen that even if the correct bra has been purchased, it must be properly adjusted in order to provide maximum comfort and support. However, many women do not understand how to properly adjust a bra. For example, if the bra cup does not snugly fit against the chest, many women do not know if the cup size is wrong, if the chest band is not tight enough, or if the shoulder straps are not properly adjusted. Moreover, once attempts have been made to properly adjust a bra, it is generally never readjusted thereafter when the dimensions have changed due to age, washing and drying of the bra which can make the elasticity change in the various parts of the bra. Much like the foregoing, the gore part of the bra should fit against the chest of the wearer, but if it doesn't, the wearer often does not know why, and thus can only make arbitrary adjustments hoping the results are better. Again, if the cup size is too small, the gore may be spaced from the wearer's chest and the only solution is to purchase a new bra. Experience by many women show that once a bra has been fitted correctly, either by choice or chance, the bra becomes comfortable and considered much like a favorite pair of worn jeans.

The difficulty in achieving a comfortable fitting bra is due in part to the fact that the breasts of most women are not symmetrical in shape, size or firmness. Indeed, the breasts of a woman can each be a different size, to the extent of a full cup size. The difference is often manifest by a woman who simply self-observes her breasts in a mirror. Different size breasts will move differently when the woman moves about. The breasts often move independently of each other in different rotational paths and rhythms. However, unless a bra is custom made, bras are generally not adapted to accommodate breasts that are different. Thus, a compromise in the fit and comfort of a bra is assumed. The outward look of a woman having different size breasts can be improved by using pads inserted into the cups of a bra. The pads can be cloth, foam or inflatable bladders, but the problem is that such pads can slip in the bra and be exposed, which is embarrassing to the woman. There are proposed bras that have inflatable bladders fixed in the bra cups, but there are often problems with achieving a desired inflation or deflation to assure a symmetrical outward appearance. In many inflatable bras and others where an insert is used to enhance the apparent size of a woman's breasts, the pads not only push in on the breasts, but also bulge the breast cup outwardly, leaving an unnatural appearance.

From the foregoing, it can be seen that a need exists for a bra that supports the wearer's breasts, but also has breast cups that are easily inflatable to achieve the desired balance in size between the breasts, and provide natural shaped breasts. Another need exists for the user to easily inflate the bladders of the breast cups to the desired breast appearance, with a valve that is integrated into the bra so as to appear as an ornament attached to the bra. Another need exists for an inflation valve attached to the bra that allows the user to easily select which bladder to individually inflate, or to inflate the bladders together, and then to disconnect the bladders from the inflation pump. Yet another need exists for a bra cup construction which allows an inflated bladder to push in on the breast tissue without bulging out the bra cup itself or otherwise distorting the shape of the bra cup. A further need exists for a mechanism to hold the breast cups together so that augmentation of the breasts by the inflated bladders creates the desired cleavage by simply self-observing the user's breasts in a mirror.

SUMMARY OF THE INVENTION

In accordance with the principles and concepts of the invention, there is disclosed an inflatable bra that includes a bladder integrated into each bra cup, and an inflation valve also integrated into the bra that allows the user to easily inflate each bladder, and then disconnect the valve from the source of fluid pressure. When the source of the fluid pressure is disconnected, a rotatable knob of the valve appears as an ornament and the connection port to the fluid pressure source is not visible.

In accordance with another feature of the invention, disclosed is a four-way inflation valve that allows each bladder to be inflated individually, or together, and then the valve can be set to an Off state to isolate the bladders from each other and from the source of fluid pressure.

In accordance with a further feature of the invention, disclosed is an inflatable bra with bladders, each having a balloon membrane that balloons out and pushes into the breast tissue, but the base of the bladders does not balloon out significantly, thereby preventing the breast cup from distorting from a natural shape. A corollary feature is a bra construction that includes a stiffener mesh built into the bra cup, against which the base of the bladder reacts to further reduce distortion of the shape of the cup during inflation of the bladder. According to another feature of the invention, the shape of the bra cups and the support provided to the breasts can be achieved without the use of underwires or similar stiffeners.

In accordance with another aspect of the invention, the inflatable bra includes a control band that extends from one bra cup to the other bra cup and prevents the cups from separating during augmentation of the breasts, thereby maintaining a desired cleavage. The control band is not laterally stretchable and can cradle the underside of both bra cups.

In accordance with yet another feature of the invention, the cups of the inflatable bra include an innermost plush material that engages the tissue of the breasts for optimum comfort.

With regard to yet another feature of the invention, the shoulder straps of the inflatable bra can be anchored to the back wings at different locations to improve the fit and comfort of the bra to the user. The relocation by the user of the location where the shoulder straps fasten to the back wings of the bra allows the bra cups to engage around each breast without gapping.

According to an embodiment of the invention, disclosed is an inflatable bra which includes a right breast cup and a left breast cup, a right inflatable bladder located in the right breast cup, and a left inflatable bladder located in the left breast cup. A valve is attached to the inflatable bra, where the valve is switchable by a user of the bra to any one of four states. The valve has an inlet/outlet port connectable to a source of a pressurized fluid, a right bladder port connectable to the right bladder for inflation thereof, and a left bladder port connectable to the left bladder for inflation thereof. The valve further includes several states, including a first state for connecting the inlet/outlet port to only the right bladder port to allow the pressurized fluid to flow from the inlet/outlet port to the right bladder port and to the right bladder. A second state is for connecting the inlet/outlet port to only the left bladder port to allow the pressurized fluid to flow from the inlet/outlet port to the left bladder port and to the left bladder. A third state is for connecting the inlet/outlet port to both the right bladder port and to the left bladder port to allow the pressurized fluid to flow from the inlet/outlet port to both the right bladder and to the left bladder. A fourth state isolates the inlet/outlet port from the right bladder port and isolates the inlet/outlet port from the left bladder port.

According to another embodiment of the invention, disclosed is an inflatable bra which includes a left breast cup and a right breast cup, a left wing attachable at an end thereof to the left breast cup and a right wing attachable at an end thereof to the right breast cup. The left and right wings are connectable together at a back of a user. A control band has a first partial shaped cup attached to a cup-shaped portion of the left breast cup, and has a second partial shaped cup attached to a cup-shaped portion of the right breast cup. The control band spans the left breast cup and the right breast cup to prevent lateral separation thereof. A screen-type mesh is used inside each breast cup to provide a stiffening agent thereto. An inflatable left bladder is attached to the left breast cup, and the inflatable left bladder has a balloon membrane sealed to a base so that when inflated the balloon membrane expands inwardly into a left breast of the user. An inflatable right bladder attached to the right breast cup, and the inflatable right bladder has a balloon membrane sealed to a base of the right bladder so that when inflated the balloon membrane of the right bladder expands inwardly into a right breast of the user. The base of the left bladder is prevented from expanding by the screen-type mesh of the left breast cup and the base of the right bladder is prevented from expanding by the screen-type mesh of the right breast cup.

According to a further embodiment of the invention, disclosed is a method of inflating an inflatable bra having two breast cups, which includes attaching an inflatable bra around a torso of a user so that a respective cup of the bra supports a corresponding left and right breast of the use. After attachment of the bra around the user, a bladder of the type having a balloon membrane attached to a base is inflated in a left breast cup so that the balloon membrane balloons into breast tissue of the left breast to displace the breast tissue in a desired direction. The base of the bladder is supported against deformation thereof with a screen-type mesh material attached to the left breast cup.

BRIEF DESCRIPTION OF THE DRAWINGS

Further features and advantages will become apparent from the following and more particular description of the preferred and other embodiments of the invention, as illustrated in the accompanying drawings in which like reference characters generally refer to the same parts, functions or elements throughout the views, and in which:

FIG. 3*a* is a cross-sectional view of a breast cup of the bra of FIG. 1;

FIG. 3*b* is an enlarged section of the construction of the bra of FIG. 3*a*, taken along line 3*b*-3*b;*

FIG. 4 is a cross-sectional view of the construction of an inflatable bladder;

DETAILED DESCRIPTION OF THE INVENTION

Figure 1:
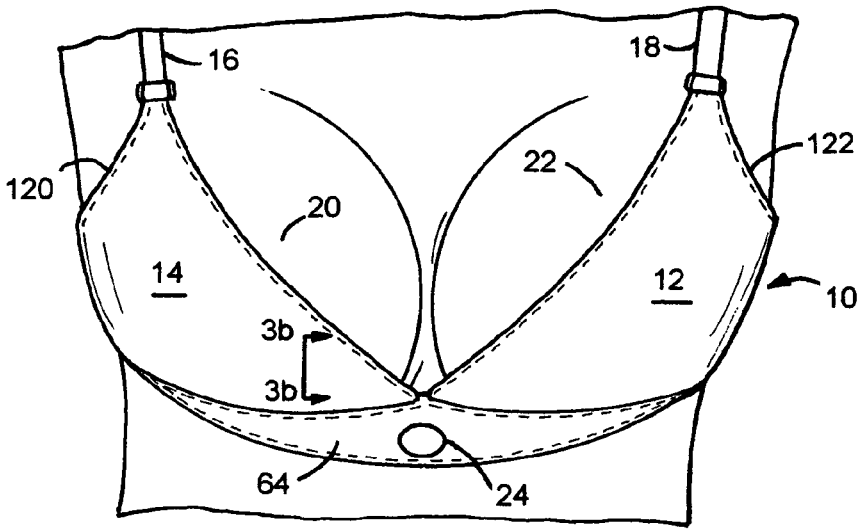
FIG. 1 is a frontal view of a bra constructed according to an embodiment of the invention.

With reference to FIG. 1, there is shown an inflatable bra 10 constructed according to an embodiment of the invention. The bra 10 includes a left bra cup 12, a right bra cup 14 and corresponding shoulder straps 16 and 18. The left bra cup 12 supports a left breast 22 and the right bra cup 14 supports a right breast 20. According to a feature of the invention, each bra cup 12 and 14 includes an inflatable bladder (not shown in FIG. 1) connected to a valve mechanism 24 so that when a source of air pressure is connected to the valve mechanism 24, one bladder, the other bladder or both bladders can be inflated or deflated to the desired pressure or size. As will be described in more detail below, the valve mechanism 24 has a frontal disc that is rotatable by the wearer of the bra 10 to select whether the source of air pressure is coupled to the left bladder, the right bladder, both bladders, or is in an Off position so that the air pressure in the bladders is maintained.

Figure 2:
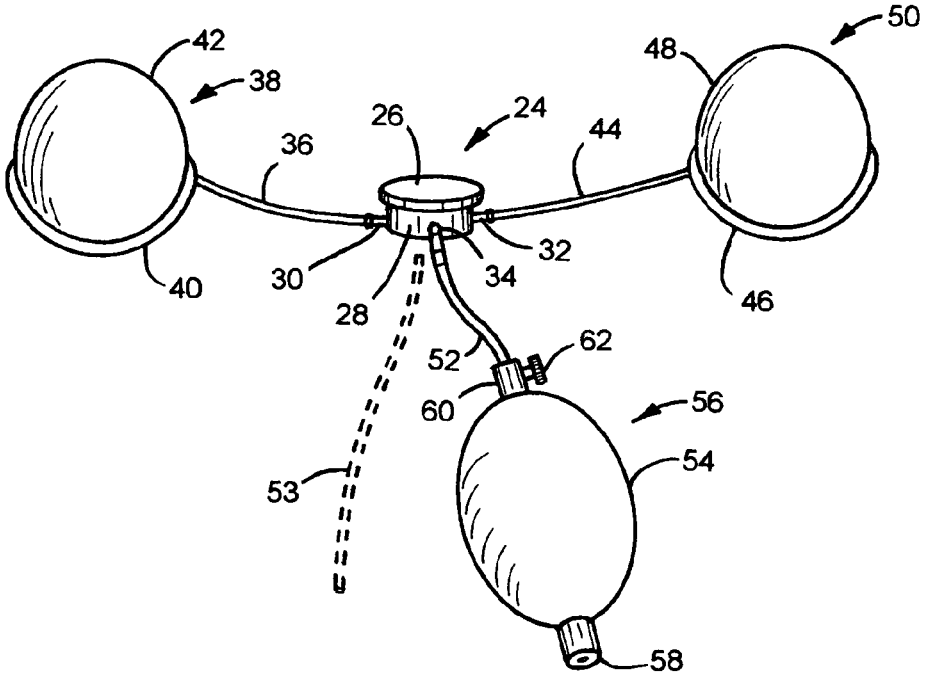
FIG. 2 is an isometric view of the inflatable bladders constructed according to an embodiment of the invention.

The bladder system of the inflatable bra 10 is shown in detail in FIG. 2. Here, the valve mechanism 24 includes a disc member 26 that is rotatable with respect to a hollow valve body 28 to select the desired state or function. The valve body 28 is connected to a first outlet port 30 that extends via flexible tubing 36 to the right bladder 38. The right bladder 38 is constructed with a base 40 sealed around a peripheral area thereof to a more resilient balloon membrane 42. The balloon membrane 42 is shown inflated so that it balloons outwardly while the base 40 deforms only slightly to conform to the shape of the bra cup 14. Indeed, the base 40 can be shaped permanently during formation thereof so as to be cup-shaped, concave or otherwise contoured to the shape of the portion of the bra cup 14 in which it is placed. The valve body 28 is also connected to a second outlet port 32 that connects via flexible tubing 44 to a left bladder 50. The left bladder 50 can be constructed similarly to the right bladder 38, with a base 46 sealed to a balloon membrane 48. It should be understood that the right bladder 38 and the left bladder 50 can be constructed with different materials to exhibit different ballooning characteristics, and constructed of different sizes or different shapes. Lastly, the valve body 28 is connected to an inlet/outlet port 34 connected by flexible tubing 52 to the bulb 54 of a hand pump 56. A conventional barb-type connection can be utilized to provide a quick-connect mechanism between the inlet/outlet port 34 and the flexible tubing 52 of the hand pump 56. Optionally, a length of flexible tubing 53, shown in broken line, can be used by user of the bra 10 to blow into for inflating the bladders 38 and 50. The end of the flexible tubing 53 can be equipped with a quick-connect type of connection that mates with a corresponding connector on the inlet/outlet port 34. For example, the length of flexible tubing 53 can be carried in a small case in the lady's purse and used to manually inflate or deflate the bladders 38 and 50 in private in a rest room stall, bedroom, automobile, or the like.

The bladder system is described above in connection with an embodiment in which the pressurized fluid is air. However, other gasses can be employed to inflate the bladders 38 and 50, such as helium, nitrogen or other suitable gas. Liquids can also be a fluid of choice for inflation of the bladders 38 and 50. Water can be pressurized and used to fill the bladders 38 and 50. As another example, one or both of the bladders 38 and 50 can be filled with a gel that remains in a soft and pliable state. An epoxy can be used to fill the bladders 38 and 50, where the epoxy is of the type that cures in a soft and pliable state. When the bladders 38 and 50 are filled with a material that cures, the valve 24 can be used in the same manner as described above to fill the bladders 38 and 50, or to remove the uncured material. However, once the material is filled to the desired look and appearance, the valve 24 is placed in the Off position. Once cured, the material may not be of sufficient liquidity to be drained out via the valve 24. In other situations, each bladder 38 and 50 can be filled with a different fluid.

The hand pump 56 is of conventional construction having an air inlet 58 to allow air to be pulled into the bulb 54 when squeezed and released. The air inlet 58 is equipped with a check valve that prevents pressurized air in the bulb from escaping out of the inlet 58. The hand pump 56 is constructed with an air outlet 60 that allows pressurized air to exit the hand pump 56 when the bulb 54 is squeezed. The air outlet 60 is equipped with a check valve that prevents air from entering into the bulb 54 once the bulb 54 is released. Lastly, the hand pump 56 is constructed with a release screw valve 62 which, when the screw is loosened by hand, the air can be released from the bladders 38 and 50 via the valve mechanism 24. The advantage of using a removable air pump is that the inflatable bra 10 can be laundered without subjecting the hand pump 56 to the hot atmospheres and detergents.

As will be described in more detail below, the valve mechanism 24 is constructed so that the user of the bra 10 can manually select the function desired, namely, select whether to connect the right bladder 38 to the hand pump 56, connect the left bladder 50 the hand pump 56, connect both the left and right bladders 50 and 38 to the hand pump 56, or maintain all valve connection ports 30, 32 and 34 isolated so that the hand pump 56 can be removed and the bladders 38 and 50 will remain in the inflated state. As such, the valve mechanism 24 is a four-way valve with a disc 26 that is manually rotatable to select the internal connections that are desired. As can be seen from FIG. 1, the valve mechanism 24 is located in the gore area (between the cups) of the bra 10 so as to be concealed, but accessible when needed. Moreover, the rotatable disc 26 of the valve mechanism 24 is located so as to be exposed at the gore area of the bra 10, but is button-like so as not to be easily recognizable as a mechanical valve mechanism. The frontal face of the rotatable disc 26 can be engraved or otherwise decorated with an emblem or other design to make it look more decorative and less utilitarian. As such, the inflatable bra 10 is not easily discernible as being of the type that is inflatable.

The inflatable bra 10 of FIG. 1 includes a control band 64 constructed of a non-stretchable material that spans the underside of both bra cups 12 and 14. As can be seen, the control band 64 generally supports the bottom outer surface of both cups 12 and 14. One purpose of the control band 64 is to resist and deformation of the bra 10 when the bladders 38 and 50 are inflated, thus, when the bladders 38 and 50 are inflated, the balloon membranes 42 and 48 push inwardly against the breast tissues and push the breasts 20 and 22 upwardly, rather than bulge the middle and bottom portions of the bra cups 12 and 14 outwardly. Stated another way, the balloon membranes 42 and 48 of the bladders 38 and 50 will cause deformation of whatever has the least resistance, in this instance the breasts 20 and 22, rather than the bra cups 12 and 14. With this construction, the breasts 20 and 22 can be pushed in desired directions. depending on where the bladders 38 and 50 are located in the bra cups 14 and 12.

FIG. 3*a* is a cross-sectional view of the right breast 20 and bra cup 14 as lifted by inflated bladder 38. The bladder 38 is illustrated integrated into the cup 14 of the bra 10, under the breast 20 to move the breast tissue upwardly and provide lift and visual enhancement or augmentation of the breast 20. By placing the bladder 38 in the lower part of the bra cup 14 to push the breast 20 upwardly, the breast 20 appears much fuller, whether revealed by low cut clothing or not. The amount of effective breast augmentation is a function of the extent to which the bladder 38 is inflated. It can be appreciated that the tissue of the breast 20 is soft and easily deformed by the bladder 38 without discomfort. The balloon membrane 42 of the bladder 38 also presents a soft pushing member against the breast 20. By employing a soft and resilient balloon membrane 42, the breast tissue is not rigidly displaced, but rather the balloon membrane 42 can move with the breast 20 during bouncing activity, and the like. In other words, as the breast 20 moves down, the balloon membrane 42 can move with the breast and does not substantially inhibit or restrict breast movement. The use of the bladder 38 thus does not inhibit the natural behavior of breast movement and is more natural in dynamic appearance. As noted above, the bladder 38 can be placed at other locations in the bra cup 14 to displace the tissue of the breast 20 at other locations and achieve different visual effects. According to a feature of the illustrated embodiment, the bladder 38 is completely hidden in the bra 10, and cannot be seen even when not worn by the user. In other words, when the woman removes the bra 10, the fact that it is inflatable is not readily discernible, especially if the bladders 38 and 50 are deflated.

The bra cup 14 is constructed of various layers of different materials, as illustrated in the enlargement of FIG. 3*b*. The sectional view of FIG. 3*b* is not taken through the bladder 38. As will be described in more detail below, the inflatable bra cup 14 is constructed with a soft innermost fabric 70 against which the skin tissue of the breast 20 touches. The fabric 70 is of the type in which a fragrance can be impregnated, either by the user of the bra 10, or the bra manufacturer. The inflatable bra 10 further includes a thin non-stretchable fabric 72 that is adhered or otherwise bonded to the outer surface of the soft fabric 70. The fabric layer 72 is a material that functions as a moisture barrier so that sweat from the breast 20 is blocked from extending to the outer-most layers of the bra cup 14. Next, the layer 74 comprises a rather stiff lightweight mesh material that functions as a stiffening agent to the bra cup 14 to resist deformation as a result of the inflated bladder 38. The layer 74 aides in allowing the breast 20 to be deformed, rather than the bra cup 14. The mesh 74 can be constructed of a plastic or other synthetic material, much like a window screen, that is cup shaped. The next bra cup layer 76 is a foam material to increase the size of the cup 14 and provide a more natural feel if the breast area of the wearer is touched. The next outer layer 78 of the inflatable bra cup 14 is constructed of a non-stretchable material. Lastly, the outer layer 80 is the material that constitutes the outer visible material of the bra cup 14, which can be lacy, imprinted with designs, etc. Those skilled in the art may find that not all of the material layers of the bra cup 14 are necessary, or that additional layers are needed to achieve various results, and that the layers can be constructed of different materials than described herein. Moreover, different layers of the bra cup 14 can be integrated into a single layer that exhibits the properties of plural layers.

FIG. 4 illustrates the construction of a bladder 38 of the inflation system, it being realized that the other bladder 50 can be similarly constructed. In the preferred embodiment, the bladder 38 is constructed with a base 40 that is less resilient than the balloon membrane 42. The difference in resiliency between the base 40 and the balloon membrane 42 is achieved by using a silicon rubber material as the base 40, with a Durometer # between about 20 and about 100, and preferably about 60. The base 40 can be generally circular with a diameter of about 2.75 inches. Other shapes and sizes can be utilized. The thickness of the base is about 0.0625 inch. In contrast, the balloon membrane 42 is constructed of a silicon material with a Durometer # of between about 5 and 30, and preferably about 20. The diameter of the balloon membrane 42 is about the same as that of the base 40, and the thickness of the balloon membrane 42 is about 0.03125 inch, i.e., about half the thickness of the base 40. In practice, the balloon member 42 is sufficiently resilient that the bladder 38 can be inflated by simply blowing (with a person's mouth) into the tubing 36. The peripheral edge of the balloon membrane 42 is bonded to the base 40 using a conventional silicone or other suitable adhesive. The circular edge of the base 40 can extend beyond the circular edge of the balloon membrane 42 to allow the base 40 to be sewn to the cup-shaped support mesh 74. Flexible tubing 36 constructed of a silicone material, natural rubber or other flexible surgical tubing is sandwiched between a portion of the base 40 and the balloon membrane 42, again using a silicone or other suitable adhesive. In order to anchor the tubing 36 to the bladder 38, a short flap 82 of rubber material is wrapped around the edge of the bladder 38 when the tubing 36 exits the bladder 38. A hole (not shown) is formed in the flap 82 through which the tubing 36 extends. The flap 82 is bonded to the tubing 36 with a silicone adhesive, and the flap 82 is also bonded around the edge of the bladder 38. As can be appreciated, the bladder assembly is constructed of materials that can withstand many washing cycles, different detergents, and elevated water and drying temperatures.

The base material 40 is constructed of a sufficiently flexible material that it conforms to the shape of the bra cup 14 and does not have an imprint that shows through to the front of the bra 10 when supporting the breast 20. Yet, the base 40 of the bladder 38 does not bulge outwardly sufficiently toward the bra cup 14 when the bladder 38 is inflated. The balloon membrane 42 is much more resilient than the base 40 so that it balloons out, as shown in the broken line in FIG. 4, when subject to air or liquid pressure within the bladder 38. When the bladder 38 is inflated, the balloon membrane 42 stretches and balloons out, but is yet soft to the feel and is thus not uncomfortable when pressed into the soft tissue of the breast 20. When the air pressure is reduced, the elasticity of the balloon member 38 allows it to relax in a corresponding manner. Because of the ease with which the membrane 42 balloons outwardly, not a lot of air pressure is needed for full inflation. As such, the balloon membrane 42 pushes softly into the breast tissue without discomfort. When fully deflated, the balloon membrane 38 lies generally flat on the base 40 without wrinkling or the like. The material of the balloon membrane 42 allows numerous inflation and deflation cycles without permanent deformation thereof. The bladders 38 and 50 can otherwise be constructed in the manner described in U.S. Pat. No. 6,461,221.

Figure 5:
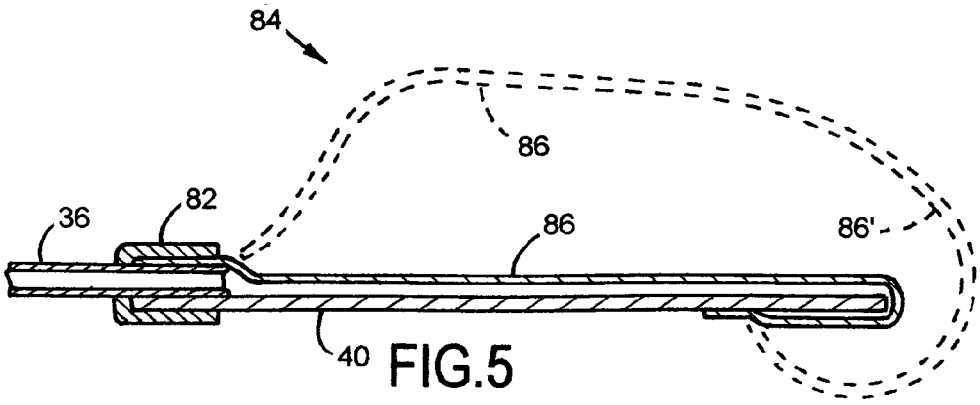
FIG. 5 is a cross-sectional view of another embodiment of an inflatable bladder.

FIG. 5 illustrates another embodiment of an inflatable bladder 84 adapted for use in a bra or other outerwear. The bladder 84 is similar to the construction of bladder 38 shown in FIG. 4, but includes a balloon membrane 86 that wraps around some or all of the peripheral edge of the base 40. The balloon membrane 86 is shown in FIG. 5 as being wrapped around the right hand portion of the peripheral edge of the base 40. As such, the balloon membrane 86 will balloon out beyond the peripheral edge as shown by balloon membrane portion 86'.

Figure 6:
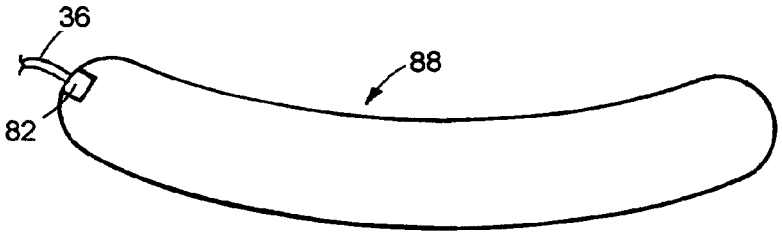
FIG. 6 is a top view of an arc-shaped inflatable bladder.

The balloon membrane can also be constructed with varying thicknesses or Durometer numbers as a function of the location on the balloon membrane. For example, those skilled in the art may desire to have the central portion of the balloon membrane more resilient so that it balloons out more than the remainder of the balloon membrane. In other applications, the bottom portion of the balloon membrane may be more resilient than the upper portion of the balloon membrane, so that the membrane balloons out more at the base of the breast. Many other variations in the resiliency of the balloon membranes can be achieved by those skilled in the art. The bladders can be constructed with shapes other than circular. In FIG. 6, there is illustrated a bladder 88 that is arc-shaped to fit within a bra cup and cradle the entire underside of the base of the breast.

FIGS. 7*a*-7*e* illustrate the different states of the four-way switch valve 24 for switching the air from the hand pump 56 to either or both of the bladders 38 and 50. The switch valve 24 includes a body part 90 having three ports formed therein. A first port 30 is for connection to the tubing 36 that extends to the right bladder 38 (FIG. 2). A second port 32 is for connection to tubing 44 that connects to the left bladder 50. The center port, or third port 34 is for connection to the hand pump 56. Alternatively, the third port 34 can be connected to a hidden length of tubing that can be blown into by the user to inflate one or both of the bladders 38 and/or 50. The switch valve 24 includes a rotatable knob 92 having a shaft 93 that is sealed to a body part 90. The rotatable knob 92 can be rotated by the user with respect to the body part 90, which remains stationary. A cover 91 is sealed to the body part 90, and has an opening therein for sealing around the rotatable shaft 93. As will be described below, the shaft 93 is connected to a rotatable valve member 97 housed in the body part 90. Rotation of the knob 92 is effective to rotate the shaft 93 and thus the valve member 97. The internal rotatable valve member 97 is only partially circular to leave a void area 99 that rotates with the knob 92.

An external O-ring 94 is fastened to the peripheral edge of the knob 92 for allowing a person to grasp the same in a positive manner and turn the knob 92 without slipping. The O-ring 94 can be fastened in an annular groove formed around the knob 92. In addition, the O-ring 94 can be formed with a transverse notch 93 that can be easily felt by the user to determine by its position the state of the switch valve 24. Rather than a notch 93, the O-ring 94 can be formed with a ridge at a specified location that is easily felt by the user's fingers so that the state of the switch valve 24 can be readily determined. The cover 91 and the body part 90 can be constructed of a rigid plastic, and sealed together with one or more seal rings, or other sealing mechanism. In practice, the switch valve 24 is about 0.5-1.0 inch in diameter and about 0.25 inch thick. The body part 90 can be equipped with an internal spring-loaded detent mechanism so that there is a positive stop at each of the four states of the switch valve 24. In the construction of the switch valve 24, the cover 91 can snap fit in a sealed manner to the body part 90.

The end of the flexible tubing 36 can be connected to the right bladder port 30 and secured thereto using a small tie wrap or spring clamp to assure that the tubing 36 is tightly connected to the switch valve 24. The end of the other flexible tubing 44 can be connected to the left bladder port 32 in a similar manner to assure that it does not become inadvertently disconnected.

Figure 7A:
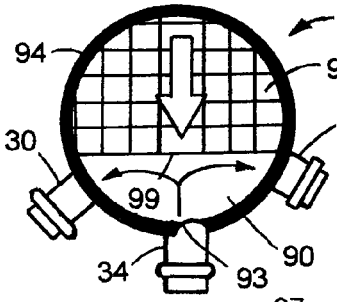
FIGS. 7*a*-7*d* are different views of the states of a rotatable switch valve for switching air pressure to the bladders of the inflatable bra.
Figure 7C:
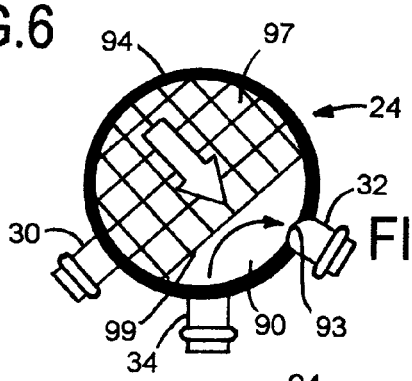

With regard to FIG. 7*a*, the switch valve 24 is shown with the rotatable valve member 97 (shown in cross hatch) that is not entirely circular, but has a void area 99 that functions to connect or disconnect the various ports. The O-ring 94 is illustrated in FIGS. 7*a*-7*d* to show the relative position of the knob 92, even though it encircles the knob 92, shown in FIG. 7*e*. The switch valve 24 is shown in a first state with the knob 92 turned so that the void area 99 of the valve member 97 couples the hand pump inlet port 34 to both the right bladder port 30 and the left bladder port 32. This is accomplished by totaling the valve member 97 (by the knob 92) so that the internal void area 99 connects each of the three ports 30, 32 and 34 together. As such, the air pressure from the hand pump 56 can be coupled via inlet/outlet port 34 to both of the bladder ports 30 and 32, as shown by the branched arrow. In this state, the air pressure from the hand pump 56 can be used to inflate both the right bladder 38 and the left bladder 50 at the same time and to the same pressure. When the switch valve 24 is in the first state, air can be transferred from one bladder to the other bladder to maintain a constant pressure in both bladders 42 and 48. This can occur if one bladder undergoes an external pressure applied thereto, whereby air can be transferred via the switch valve 24 to the other bladder.

Figure 7B:
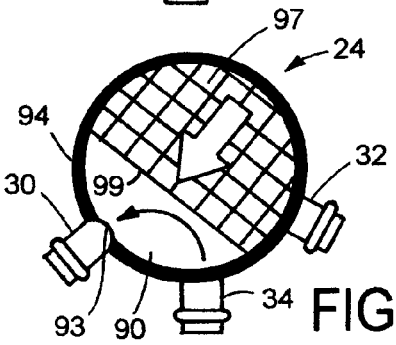

With reference to FIG. 7*b*, the switch valve 24 is shown in the second state where the knob 92 is turned clockwise so that the internal void area 99 couples the hand pump inlet/outlet port 34 to only the right bladder port 30, and the left bladder port 32 is disconnected from the hand pump inlet/outlet port 34. In the second state, the air pressure from the hand pump 56 is effective to inflate only the right bladder 38. If the knob 92 is rotated counterclockwise from that shown in FIG. 7*a* to a third state shown in FIG. 7*c*, the hand pump inlet/outlet port 34 is connected to only the left bladder port 32. In the third state, the right bladder port 30 is disconnected from the hand pump inlet/outlet port 34, whereupon only the left bladder 50 can be inflated. As between the second state of FIG. 7*b* and the third stale of FIG. 7*c*, the right bladder 38 can be inflated to a pressure different from that of the left bladder 50. The right bladder 38 and the left bladder 50 may be inflated to different sizes, even though the inflation pressures are the same. This is because the resiliency or thickness of the balloon members 42 and 48 of the bladders 38 and 50 may not be exactly the same, and may change over time due to aging or to the effects of hot water during repeated laundering cycles.

Figure 7D:
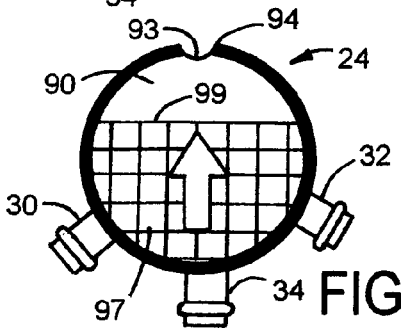

FIG. 7*d* illustrates the fourth state of the switch valve 24, where the knob 92 is rotated so that the internal void area 99 is turned so as to isolate all three ports 30, 32 and 34 from each other. This is the Off state of the switch valve 24. In other words, the internal void area 99 of the knob 92 is turned so that no ports are coupled together by the void area 99. In the fourth state, the right bladder port 30 is isolated and thus no air can enter or exit the right bladder 38. Similarly, in this state the left bladder port 32 is isolated and thus no air can enter or exit the left bladder 50. Once the bladders 38 and 50 have been inflated to the desired pressures, as exhibited by the desired augmentation of each of the breasts 20 and 22, the switch valve 24 can be rotated to the fourth state (FIG. 7*d*) so that the bladders 38 and 50 remain at the desired sizes, and isolated from each other.

When it is desired to wash the inflatable bra 10, the switch valve 24 can be switched to the fourth state to prevent water from filling the internal cavity of the valve 24 with water and detergents, which could subsequently allow water to enter one or both of the bladders 38 and 50. Those skilled in the art may prefer to spring load the knob 92 so that it always rotates to a rest or Off state, namely the fourth state. With the foregoing in mind, those skilled in the art may find it advantageous to design the switch valve 24 so that when the user has inflated both bladders 38 and 50 to the desired pressures, then the knob 92 can be pushed inwardly, whereupon a spring bias automatically returns the valve 24 to the Off state.

When it is desired to deflate the bladders 38 and 50, the user of the bra 10 can place the switch valve 24 in the second state of FIG. 7*b* with the hand pump 56 either connected or disconnected from the bladder port 34. If the hand pump 56 is disconnected from the inlet/outlet port 34 in the second state, then the air can be released from the right bladder 38 to the atmosphere. If the hand pump 56 is connected to the inlet/outlet port 34, then the release screw 62 can be operated to allow the air to escape from the right bladder 38 at a controlled rate. This is advantageous when the right bladder 38 was inflated too much, and it is desired to deflate the right bladder 38 a certain amount.

The switch valve 24 can be removed from the second state (FIG. 7*b*) and placed in the third state (FIG. 7*c*) by rotating the knob 92 clockwise from the second state through the fourth state to the third state, and vice versa, so that no air pressure is lost in either bladder during switching from the one state to the other state. This procedure can be employed when it is desired to inflate the left bladder 38 and the right bladder 50 to different air pressures. For example, the user may inflate both bladders 38 and 50 to the same pressures using the first state of FIG. 7*a*, then decide that the right bladder 38 needs more or less air pressure, whereupon the switch valve 24 can be placed in the second state of FIG. 7*b* to continue inflation using the hand pump 56, or deflate the right bladder 38 using the screw release valve 62 attached to the hand pump 56. At this time, the user may decide the left bladder 50 requires more or less air, whereupon the switch valve 24 can be switched from the second state of FIG. 7*b* through the fourth state of FIG. 7*d* to the third state of FIG. 7*c* without disturbing the air pressure in the right bladder 38. This back and forth inflation/deflation of either bladder can be continued in front of a mirror until the user is satisfied with the extent of augmentation of both breasts 20 and 22. This usually means that the appearance of both breasts 20 and 22 are of the desired size and the same size.

Figure 8:
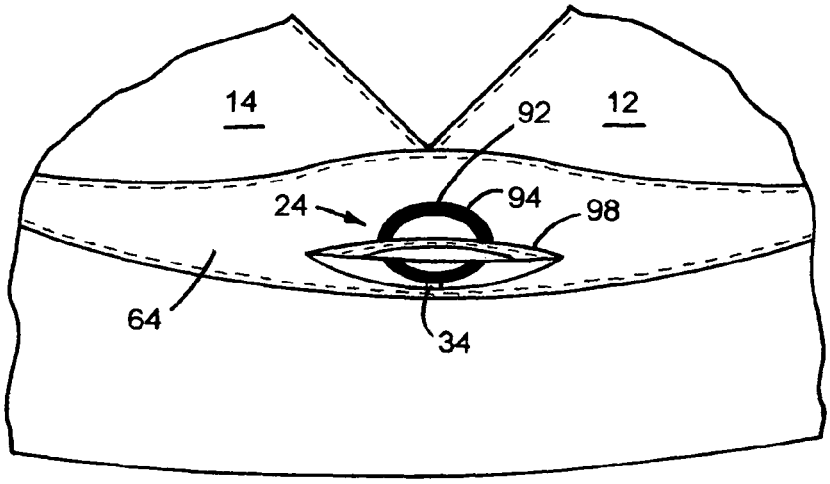
FIG. 8 is a partial frontal view of the inflatable bra, showing access to the otherwise hidden inlet/outlet port of the switch valve.

FIG. 8 illustrates the manner in which the inlet/outlet port 34 of the switch valve 24 is hidden, but can be accessed by lifting a flap 98 formed in the control band 64 of the bra 10. The flap 98 can be constructed by forming a slit in the outer layer of the control band 64 so that when lifted, as shown in FIG. 8, the bottom portion of the switch valve 24 is exposed. In the preferred embodiment, the inlet/outlet port 34 is exposed so that the flexible tubing 52 of the hand pump 56 can be attached thereto. Once connected, the user of the bra 10 can inflate the bladders 38 and 50 individually, or together, depending on the state of the rotatable knob 92. After the proper inflation has been achieved by the user, the knob 92 of the switch valve 24 can be rotated to the Off state, and the flexible tubing 52 can be disconnected. The flap 98 can then be folded down over the bottom of the switch valve 24 thereby concealing the connections from view. If desired, the flap 98 can be held down with a snap or with hook and loop material, or other suitable fastening means.

Figure 7E:
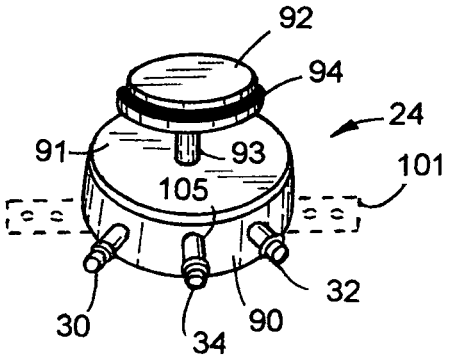
FIG. 7*e* illustrates a rotatable switch valve constructed according to another embodiment.

As illustrated in FIG. 7*e*, the switch valve 24 can be constructed with two or more plastic side wings 101 for fastening to the control band 64. The side wings 101 of the switch valve 24 can be constructed with holes therein for stitching to the control band 64 to thereby fasten the switch valve 24 thereto. Other arrangements can be used to fasten the switch valve 24 to the control band 64.

Figures 9, 10:
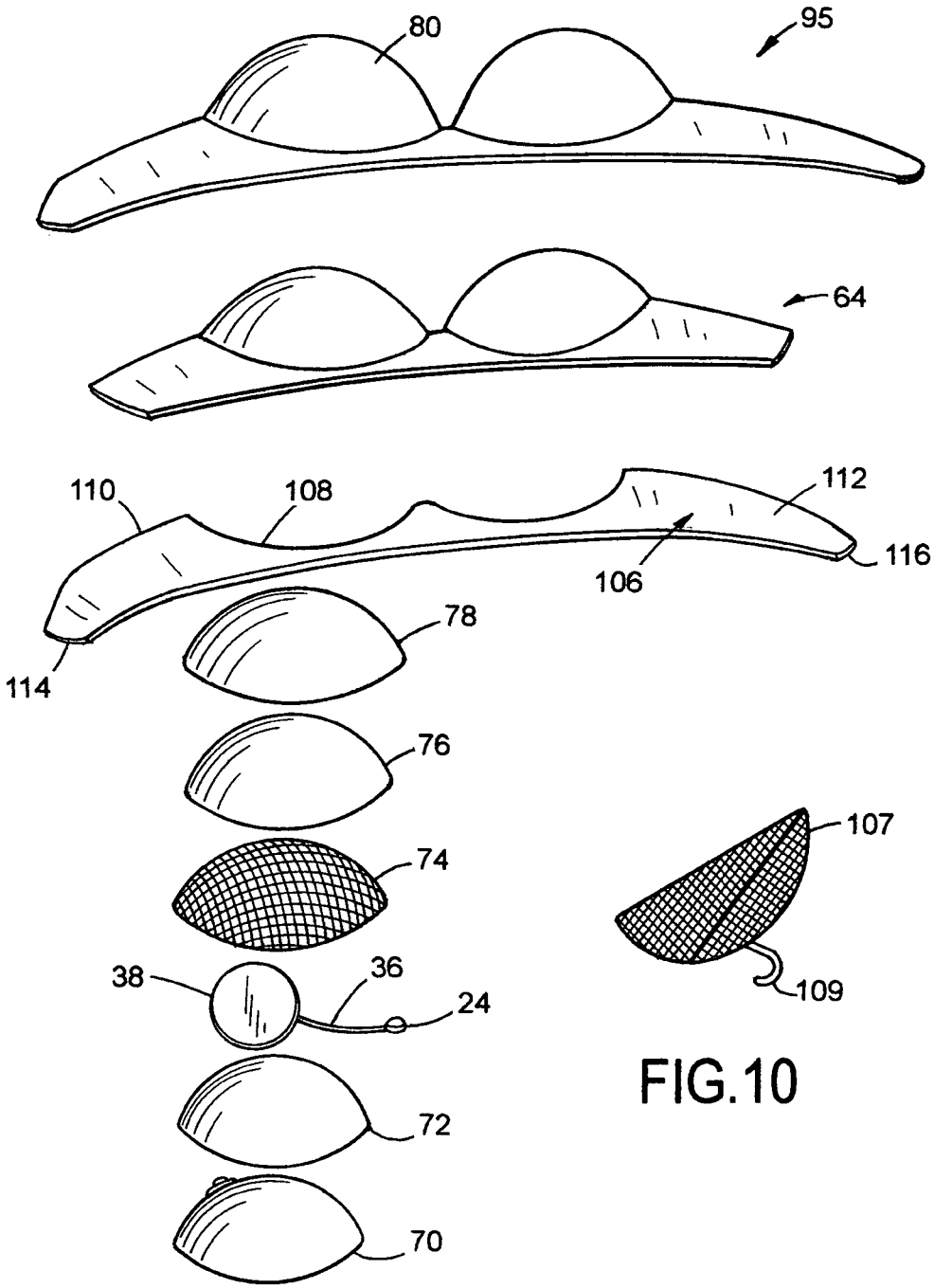
FIG. 9 illustrates in exploded form the various components of the inflatable bra according to one embodiment of the invention.
FIG. 10 is a partial frontal view of a metallic screen-type mesh used in the inflatable bra to reduce the adverse effects of radiation.

FIG. 9 illustrates the various components of a strapless inflatable bra 95 according to an embodiment of the invention. The detailed construction of the right breast cup 14 is illustrated, it being understood that the left breast cup 12 is identically constructed. The bra layer that contacts the breast tissue, i.e., the innermost layer of material of the bra 95 is a soft fabric 70, such as a thin layer of felt-like or velour material, or other suitable soft material. The soft fabric 70 being absorbent, also absorbs sweat and moisture exuded by the breast tissue. Moreover, the soft material of the fabric 70 is less abrasive to the breast tissue if the breast tissue moves with respect to the breast cup 14, such as during exercising, running, etc.

Adhered or otherwise bonded around the frontal surface of the soft fabric 70 is a moisture barrier layer 72. The moisture barrier 72 is a very thin tightly woven material, or other suitable material, that prevents moisture from the breasts from migrating to the outer components of the inflatable bra 95. Preferably, the moisture barrier 72 is of the type of material that is impervious to moisture, but allows air to pass therethrough. The moisture barrier 72 is not stretchable and is spray bonded only to the outer peripheral surface of the soil fabric 70. The inner portion of the moisture barrier 72 is not attached to the soft fabric 70, and thus these two layers are free to move with respect to each other during inflation of the bladder 38. Nevertheless, the moisture barrier 72 being non-stretchable provides some degree of support to the soft fabric 70. A conventional 3M77® spray adhesive is well suited for bonding the moisture barrier 72 to the frontal peripheral surface of the soft fabric 70, and withstands numerous laundry operations. Nonetheless, the layers 70 and 72 are flexible and thin and easily conform with the balloon membrane 42 when inflated. As will be described below, the bladder 38 is located outside of the moisture barrier 72.

A moisture absorbing material can be integrated into the frontal surface of the moisture barrier 72 to collect moisture and sweat that has collected in the soft fabric 70. The moisture absorbing layer could completely cover the inner surface of the moisture barrier 72, or a portion thereof. For example, the moisture absorbing material could be located at the bottom portion of the moisture barrier 72, and the top of the moisture barrier 72 could be constructed with small channels or grooves to allow the moisture to migrate by gravity or be wicked downwardly to the moisture absorbing material.

Fastened around a peripheral edge thereof the moisture barrier 72 and the soft fabric 70 is the screen-type mesh layer 74. The mesh layer 74 can be a fiberglass material of conventional construction, that is cup-shaped and bonded to the peripheral edge of the inner component layers 70 and 72 by a silicone or other suitable adhesive. The mesh layer 74 is formed in a cup shape before being integrated into the breast cup 14. The pre-shaping of the mesh layer 74 to a cup configuration can be accomplished by thermal and compression techniques. Bonded to the inner surface of the mesh layer 74 is the base 40 of the bladder 38. The bonding agent can be a silicone adhesive. Other techniques can be employed, including vulcanizing the rubber base layer 40 of the bladder 38 at the desired location on the mesh layer 74. As noted above, the mesh layer 74 provides a contoured support to the base 40 of the bladder 38 to prevent the breast cup 14 from bulging out when the bladder 38 is inflated. The flexible tubing 36 that is connected between the bladder 38 and the switch valve 24 is routed between the breast band 106 and the control band 64. The short length of the flexible tubing 36 that extends from the bladder 38 to the peripheral edge of the mesh layer 74 can be bonded thereto so as not to be loose. In addition, the length of the flexible tubing 36 that extends between the peripheral edge of the mesh layer 74 and the switch valve 24 can also be bonded between the material of the breast band 106 and the control band 64. It is noted that the balloon membrane 42 of the bladder expands into the layer of the thin soft fabric 70 and the thin moisture barrier 72. Thus, the balloon membrane 42 does not itself contact the breast tissue, but through the layers 70 and 72. This construction reduces the chances of the breast tissue being allergic to the various rubber and resilient materials with which the bladder 38 can be constructed. In view of the foregoing construction, the balloon membrane 42 is not adhered to the outer surface of the moisture barrier 72, but can effectively with respect to the moisture barrier 72 during expansion of the balloon membrane 42.

FIG. 10 illustrates another mesh material 108 adapted for use in the inflatable bra 95. The mesh material 107 is a conductive screen, such as aluminum, which can be employed to adhere the bladder 38 thereto, and fasten the mesh material 107 to the circumferential edge of the moisture barrier 72. The conductive mesh layer 107 includes a flexible and conductive pigtail 109 or other conductive strip that contacts the tissue of the user of the bra 95. The conductive pigtail 109 can be wrapped around an edge of the bra 10 so as to contact the skin of the wearer. Accordingly, the ambient radiation or machine generated radiation that is harmful to the breast tissues can be conducted as minute currents to the person's body and ground and not harm the user. The fineness of the metallic screen mesh may be related to the wavelength of the radiation to be grounded, and thus the particular type of metallic screen can be selected accordingly. It is believed that certain radiation wavelengths, including gamma rays carried by sunshine, are harmful to a woman's breast tissue, and thus prolonged exposure should be avoided. The level of radiation increases with increased altitudes. For example, people are exposed to increased radiation levels while in airplanes, while climbing mountains, etc. X-rays are also harmful to breast tissue during prolonged exposure, It is speculated that airport scanners emit radiation that may be harmful to a woman's breasts during repeated exposures. The adverse effects of radiation on a woman's breasts can be reduced by incorporating the conductive mesh into bras of many different types of outerwear including but not limited to bikini tops, swimsuits, halter tops, tube tops, etc. In addition, many other clothing items can have incorporated therein conductive meshes and foils that protect the underlying skin and body tissues from the harmful effects of radiation. Conductive meshes and foils can also be incorporated into gloves, caps, hats, socks, shirts, pants, sunglasses, etc.

The next layer 76 of the right breast cup 14 comprises a padding material, such as a thin layer of open cell foam rubber. The thickness of the padding layer 76 can be about 0.125 to 0.5 inch. The padding layer 76 provides to the bra 95 an external feel similar to the breast tissue, and increases the size of the cup 14. The thickness of the padding layer 78 can be greater, or less, depending on the visual effect and feel desired by the user. The padding layer 76 is attached to the mesh layer 74 by thermal bonding techniques.

The outer covering 78 of the padding layer 76 is a thin non-stretchable cover material, such as a cotton material. The cover layer 78 functions to maintain the integrity and the feel of the bra cup, and is attached to the padding layer 76 by thermal bonding techniques. The bottom curved part of cover layer 78 is also sewn to the breast band 106 around the indention or cutout 108.

The breast band 106 of the inflatable bra 95 includes a right wing 110 and a left wing 112, each of which wrap around the user and meet at the back. The breast band 106 can be constructed of a lightweight and soft stretchable material, such as spandex, or other material conventionally used in the field to construct bra breast bands. The inside surface of the breast band 106 contacts the user's skin as the breast band 106 wraps around the user. The end of each wing 110 and 112 can be equipped with a fastener. In the preferred embodiment, the end of the right wing 110 is equipped with one or more fastener loops 114, and the end of the left wing 112 is equipped with a corresponding number of hooks 116.

As noted above, the strapless inflatable bra 95 includes a control band 64 constructed of a non-stretchable material. Because of the use of the control band 64, under wire supports are not necessary. As noted above, the control band 64 is attached to the bottom cup-shaped surfaces of the breast cups 12 and 14 to prevent sideways movement of each of the user's breasts 22 and 20. The expansion of the bladder 38 during inflation pushes the breast tissue upwardly by the control band 64, rather than causing the front area of the bra cup 14 to bulge outwardly. Because of the support provided to the breast cups 12 and 14 by the control band 64, less loads are transferred to the shoulder straps. As such, the inflatable bra 10 equipped with shoulder straps is much more comfortable for the woman to wear. The control band 64 can thus be employed in other conventional bras that are not inflatable. The control band 64 also supports the switch valve 24 therein in the lower part of the gore area.

While not shown, the control band 64 can be constructed in two parts that are connectable in front, in the gore area of the bra 95. The frontal connection of the two-part control band could be made adjustable very much like the hook and loop connections 114 and 116 at the ends of the breast band 106, or other suitable fastener mechanism that provides easy adjustment. In other words, when the control band 64 is made adjustable, the support between the left breast cup 12 and the right breast cup 14 can be controlled. For example, the adjustable control band 64 can be made effectively shorter to bring the breast cups 12 and 14 closer together to increase the cleavage, or could be adjusted so as to effectively lengthen the control band 64 and allow the breasts 20 and 22 to be separated more. When constructing an adjustable control band 64, the switch valve 24 can be located in another location on the control band 64, other than the center of the control band 64.

The outermost layer 80 of material provides an external covering to the inflatable bra 95. The outer layer 80 can be decorative for appearance purposes, i.e., include lace, designs, colors, etc. The outer layer 80 can be constructed of a soft cotton or other suitable material. The control band 64 is sewn around the peripheral edge thereof to the outer layer 80. At the same time, the outer layer 80 and the control band 64 are sewn to the breast band 106. If shoulder straps are desired, then such straps can be sewn from the top of the respective cups of the outer layer 80 to the respective wings 110 and 112. The shoulder straps can be crossed in the back of the user, or configured in any other conventional manner.

Figure 11:
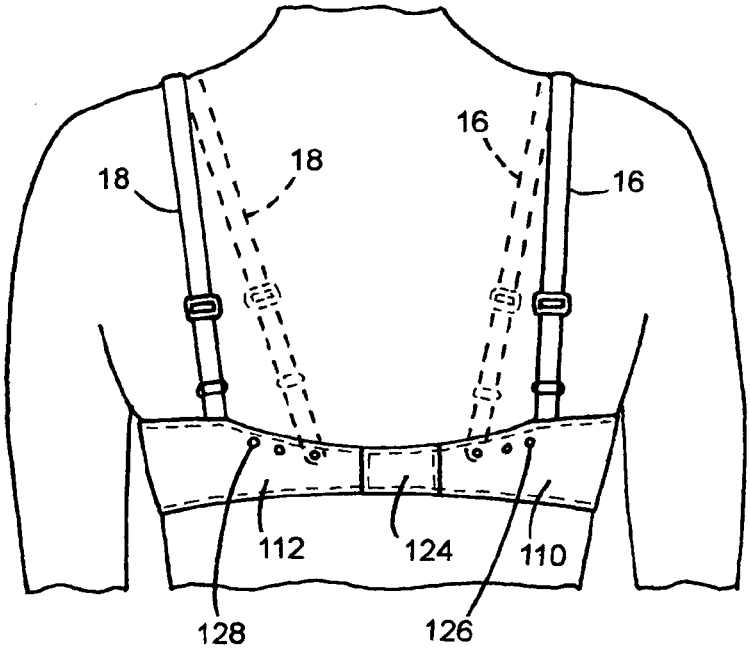
FIG. 11 is a back view of the various bra straps, showing the relative positions of adjustable shoulder straps.

It has been found that the anchor position of the shoulder straps 16 and 18 (FIG. 1) to the wings 110 and 112 is important to the proper fit of the inflatable bra 10 to the user. In particular, the side area 120 and 122 of bras can gap open due to improper placement on the wings 110 and 112 in the back of the user. The ends of the wings 110 and 112 are shown fastened together in FIG. 11 with a conventional hook and loop arrangement 124. Illustrated is a configuration (in solid lines) of the shoulder straps 16 and 18 as attached to the respective wings 110 and 112. The back ends of the shoulder straps 16 and 18 are usually sewn to the wings 110 and 112. If it is desired to move the anchor position of the bottom ends of the shoulder straps 16 and 18, as shown in broken lines, then the user must unfasten or cut the ends of the shoulder straps 16 and 18 from the wings 110 and 112 and resew them at different locations. Moreover, some experimentation may be required in order to find the correct anchor point for the particular bra. And, the correct anchor point for each shoulder strap 16 and 18 may be different for each strap. As noted above, the repositioning of the anchor locations of the shoulder straps 16 and 18 can be achieved to prevent gapping of the bra cups 12 and 14 over the breasts 20 and 22 of the user.

The back ends of the shoulder straps 16 and 18 can be equipped with releasable fasteners at various positions on the respective wings 110 and 112. Female snaps are shown as numerals 126 and 128 on the wings 110 and 112. A corresponding male snap would be fastened on the end of each of the shoulder straps 16 and 18. With this arrangement, the ends of the shoulder straps 16 and 18 can be positioned and repositioned at different locations on the wings 110 and 112. Rather than the use of snaps, other fastening mechanisms can be employed, such as hook and loop material known as Velcro®, and others.

From the foregoing, disclosed is an inflatable bra that allows the user to adjust the size of the bladders to achieve a desired balance between the size and position of each breast. The bra construction allows the inflated bladders to push in and deform the breast tissue, rather than cause the breast cups to bulge outwardly. An inflation valve is embedded within the bra so as not to be noticeable, but allows the bladders to be inflated individually, or together, and deflated to desired sizes, and then to be placed in an off state to maintain the inflation of each bladder. The bra is constructed to maintain the breast cups in a desired position with respect to each other so that when the breasts are effectively augmented by the inflated bladders, the breasts are maintained close together to form a desired amount of cleavage. Other advantages of the bra are described herein when constructed according to the various features.

In the embodiments of the inflatable bra described above, it is contemplated that the bladder system will be incorporated into the bra when manufactured. Thus, a purchaser of the bra can experiment with different inflation pressures in each bladder in order to obtain effective augmentation of one or both breasts. The user can dynamically observe the results while looking into a mirror, and increase or decrease the bladder pressures until the desired results have been obtained. If the same results are desired repeatedly, then the hand pump can be equipped with a pressure gauge so that the user can simply inflate each bladder to the pressure that has been previously found to be optimum. In other words, if the user deflates the bladders after each use, or before laundering the inflatable bra, the bra can thereafter be inflated to the predetermined pressures by looking at the pressure gauge, even if the bra is not then being worn.

Other than using the inflatable bra of the invention to make a person's breasts look normal and the same size, the bladders can be inflated to other pressures to further enhance the breasts. For example, when wearing an evening gown or a low cut gown, the user can inflate the bladders somewhat more than the usual pressure, whereupon more of the breasts will be exposed and more cleavage will be seen.

Other than manufacturing bras with the bladder system therein, it is contemplated that the inflatable bras can be marketed through a series of boutique stores which specialize in women's undergarments, lingerie, trendy clubwear, etc. Here, the inflatable bra can be equipped with cups, where each cup has an inner pocket in which a bladder can be placed. An assistant can help a prospective purchaser on the use of the inflatable bra by inflating each bladder to show the results that can be obtained. Moreover, the assistant can be trained to assist the potential user in the proper adjustment of the inflatable bra, including the shoulder straps. The bladders in each pocket can be repositioned in the pockets in order to displace the breast tissue in the proper direction, and extent, so that if the breasts are not the same size, or hang differently, they will appear more symmetrical after the bra is properly adjusted. Then, the bladders can be fixed within the pockets by sewing or adhesive, so that subsequent adjustment is not necessary. When the inflatable bra is equipped with bladder pockets in each cup, this is an opportunity to select a bladder size and shape to accommodate the particular size and shape of the breasts of the potential purchaser. To that end, each inflatable bra can be custom made to the individual and the particular idiosyncrasies of each individual. The bladders can be shaped other than round, as shown and described above. Indeed, the bladders can have inflatable fingers extended from a main bladder, where the fingers can fill out various parts of the bra cup not otherwise occupied by breast tissue. In the event that a person has the type of breasts where periodic pressure adjustment is not necessary, then the assistant can help the potential user with selecting the proper size and shape bladders for use in the inflatable bra. Then, the bladders can be pressurized to the correct pressures to achieve the results desired by the purchaser. Once the desired size is obtained, the bladders can be deflated and evacuated of air and refilled with a pliable and soft gel so that the same size is again obtained. The gel can be allowed to cure so that the bladder size is set and need not be altered thereafter.

The bladder system of the inflatable bra can be equipped with a pressure pump attached to the bra itself. A flat push-type diaphragm pump can be integrated into the layers of the bra so that when pressed a number of times, a tubing connected thereto to the bladder is effective to inflate the bladder. One pump can be employed to inflate both bladders, or each bladder can be equipped with a separate pump. If each bladder is inflated by a separate pump, then the switch valve may not be necessary.

According to another embodiment of the inflatable bra, the various components thereof can be integrated into a garment, rather than into a separate bra itself. For example, the inflatable bra components can be integrated into the cups of a wedding gown so that the bride does not have to wear a separate bra. Some or all of the inflatable bra components can also be integrated into other garments, such as swim suits, bikini tops, etc. When integrated, as some or all of the components described above, into a garment, it is nevertheless considered herein as a bra as claimed below.

The control band of the inflatable bra provides lateral support to prevent the breasts from hanging outwardly. Rather, the control band keeps the breast cups together and thus the breasts. This accentuates the cleavage between the breasts. As an alternative, the breast cups can be fastened together with a control band that is simply a nonstretchable material that fastens the cups together. Indeed, if it is desired to maintain the cups separated a specified amount, then a stiffener can be fastened between the cups to maintain the bra cups separated a specified amount.

The principles and concepts of the invention can be employed in items other than bras. An inflatable bladder can be integrated into men's undergarments to enhance the groin area of a man. Inflatable bladders can be integrated into underclothes to enhance the buttock areas of the wearer. Those skilled in the art can employ the concepts of the invention and apply the same to many other items used to adorn a person.

While the preferred and other embodiments of the invention have been disclosed with reference to specific inflatable bras, and associated methods thereof, it is to be understood that many changes in detail may be made as a matter of engineering, design and fashion choices without departing from the spirit and scope of the invention, as defined by the appended claims.

What is claimed is:

1. An inflatable bra, comprising:

a right breast cup and a left breast cup;

a right inflatable bladder located in said right breast cup;

a left inflatable bladder located in said left breast cup;

a valve attached to said inflatable bra, said valve switchable by a user of the bra to any one of four states, said valve having;

an inlet/outlet port connectable to a source of a pressurized fluid;

a right bladder port connectable to said right bladder for inflation thereof;

a left bladder port connectable to said left bladder for inflation thereof;

said valve having a first state for connecting said inlet/outlet port to only said right bladder port to allow the pressurized fluid to flow from said inlet/outlet port to said right bladder port and to said right bladder;

said valve having a second state for connecting said inlet/outlet port to only said left bladder port to allow the pressurized fluid to flow from said inlet/outlet port to said left bladder port and to said left bladder;

said valve having a third state for connecting said inlet/outlet port to both said right bladder port and to said left bladder port to allow the pressurized fluid to flow from said inlet/outlet port to both said right bladder port and to said left bladder port and to the respective right bladder and left bladder; and said valve having a fourth state in which said inlet/outlet port is isolated from said right bladder port and isolated from said left bladder port; and including a hand-operated pump connected by a flexible tubing to the inlet/outlet port of said valve, wherein said hand-operated pump includes a bulb which can be squeezed to pump a fluid to the inlet/outlet port of said valve, said pump including a screw valve for allowing said left bladder and said right bladder to be deflated by reverse flow of the fluid through the screw valve when opened.

2. The inflatable bra of claim 1, wherein said valve includes a rotatable knob for selecting at least one of the four states.

3. The inflatable bra of claim 2, wherein said valve further includes a valve member comprising a rotatable disc having a void area that connects said ports in desired configurations, and wherein said valve member is rotated by said rotatable knob to four positions corresponding to said four states.

4. The inflatable bra of claim 2, wherein said rotatable knob is located at a front of said bra and exposed so as to be available to the user of the bra.

5. The inflatable bra of claim 1, further including a right flexible tubing connecting the right bladder port of said valve to said right bladder, and a left flexible tubing connecting the left bladder port of said valve to said left bladder.

6. The inflatable bra of claim 1, wherein said left bladder is constructed of a flexible base that conforms to a shape of the left bra cup, and said left bladder includes a balloon membrane sealed to said base, said balloon membrane is more resilient than said flexible base for ballooning outwardly when inflated with the pressurized fluid, a Durometer number of said flexible membrane is more than three times a Durometer number of said base, and the base is thicker than said balloon membrane.

7. The inflatable bra of claim 1, further including a control band for attaching said left breast cup and said right breast cup together at a front of said inflatable bra, said valve attached to said control band, said control band having a flap that can be moved to expose the inlet/outlet port of said valve so that the pressurized fluid source can be attached thereto, and said flap can be moved to cover the inlet/outlet port so that it cannot be seen.

8. The inflatable bra of claim 7, wherein said control band is constructed of a non-stretchable material, said control band having a portion that is configured to fit against a user's torso, and respective cup-shaped portions of said control band covering bottom portions of the left and right breast cups, said control band for preventing movement laterally apart of the user's left and right breasts to maintain a cleavage between the left and right breasts.

9. The inflatable bra of claim 1, wherein said right bladder includes a balloon membrane that balloons out when inflated, said balloon membrane is circular shaped so that when inflated a cross-section of said balloon membrane is generally circular, said inflated balloon membrane configured to push on a circular area of a user's right breast.

* * * * *